US008777034B1

(12) United States Patent
Town

(10) Patent No.: US 8,777,034 B1
(45) **Date of Patent: *Jul. 15, 2014**

(54) CONTAINMENT BAG SYSTEM FOR USE IN A COMMERCIAL DISPOSAL CONTAINER

(75) Inventor: Troy Town, Clinton, LA (US)

(73) Assignee: PacTec, Inc., Clinton, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/469,958

(22) Filed: May 11, 2012

Related U.S. Application Data

(63) Continuation of application No. 10/193,558, filed on Jul. 11, 2002, now Pat. No. 8,191,722, which is a continuation-in-part of application No. 09/930,408, filed on Aug. 15, 2001, now abandoned.

(51) Int. Cl.
*B65D 1/06* (2006.01)

(52) U.S. Cl.
USPC ..... 220/1.6; 220/495.06; 220/908.1

(58) Field of Classification Search
CPC ..... B65D 90/046; B65D 90/04; B65D 2590/046; B65D 2590/0066; B65D 88/123; B65D 88/122; B65F 1/06; B65F 1/04
USPC ..... 220/1.6, 908.1, 495.06; 383/98, 97, 99, 383/109, 61.1, 61.3
See application file for complete search history.

(56) References Cited

U.S. PATENT DOCUMENTS 525,951 A 9/1894 Flaniken
977,698 A 12/1910 Barksdale
2,215,689 A 9/1940 Dickson
2,216,527 A 10/1940 Weiss et al.
2,524,584 A 10/1949 Zehr
2,574,345 A 11/1951 Montgomery
2,683,262 A 7/1954 Foss
2,712,797 A 7/1955 Woehrle et al.
2,861,735 A 11/1958 Faltin
2,883,041 A 4/1959 Pfeifer et al.
2,998,340 A 8/1961 Conway et al.
3,167,209 A 1/1965 Jones
3,219,240 A 11/1965 Campbell, Jr.
3,306,328 A 2/1967 Markus
3,422,867 A 1/1969 Wu
3,459,357 A 8/1969 Egger et al.
3,468,102 A 9/1969 Farrar et al.
3,481,461 A 12/1969 Paxton
3,539,360 A 11/1970 Wood
3,570,751 A 3/1971 Trewella
3,578,213 A 5/1971 Clarke et al.
3,617,418 A 11/1971 Miller
3,756,469 A 9/1973 Clark et al.
3,834,528 A 9/1974 Pickford et al.
3,888,163 A 6/1975 Watanabe
3,893,595 A 7/1975 Khanna et al.
3,987,959 A 10/1976 Deards et al.
4,119,127 A 10/1978 Klug
4,194,652 A 3/1980 Williamson et al.
4,207,937 A 6/1980 Sandeman et al.
(Continued)

*Primary Examiner* — Stephen Castellano
(74) *Attorney, Agent, or Firm* — Jones Walker LLP

(57) ABSTRACT

The invention consists of a non-self supporting containment bag used in conjunction with a dumpster container. The bag has a zipper or other sealable means, and a series of pick-up or attachment loops or handles that may also be attached to the outer bag material. The bag is constructed of at least two layers, a first layer constructed of woven materials and a second layer constructed of non-woven materials.

9 Claims, 7 Drawing Sheets

(56) References Cited

U.S. PATENT DOCUMENTS

| | | | | |
|---|---|---|---|---|
| 4,385,953 | A | | 5/1983 | Beck |
| 4,395,067 | A | | 7/1983 | Robin |
| 4,461,402 | A | | 7/1984 | Fell et al. |
| 4,557,400 | A | | 12/1985 | Clarke |
| 4,570,820 | A | | 2/1986 | Murphy |
| 4,671,733 | A | | 6/1987 | Krein |
| 4,730,942 | A | | 3/1988 | Fulcher |
| 4,754,914 | A | | 7/1988 | Wischusen, III |
| 4,759,742 | A | | 7/1988 | Achelpohl |
| 4,817,824 | A | | 4/1989 | LaFleur et al. |
| 4,850,508 | A | | 7/1989 | Lee |
| 4,871,046 | A | | 10/1989 | Turner |
| 5,041,317 | A | | 8/1991 | Greyvenstein |
| 5,073,035 | A | | 12/1991 | Williams |
| 5,110,005 | A | | 5/1992 | Schilling |
| 5,127,893 | A | | 7/1992 | Lafleur |
| 5,297,870 | A | | 3/1994 | Weldon |
| 5,467,853 | A | * | 11/1995 | Pelletier ..... 190/11 |
| 5,664,887 | A | | 9/1997 | LaFleur |
| 5,810,478 | A | | 9/1998 | LaFleur |
| 5,938,338 | A | | 8/1999 | McDonough |
| 6,029,723 | A | | 2/2000 | Baquero et al. |
| 6,079,934 | A | | 6/2000 | Beale |
| 6,155,772 | A | | 12/2000 | Beale |
| 6,186,713 | B1 | | 2/2001 | Bonerb |
| 6,250,488 | B1 | | 6/2001 | Narahara et al. |
| 6,305,845 | B1 | | 10/2001 | Navin |
| 6,427,475 | B1 | | 8/2002 | DeFelice et al. |
| RE37,915 | E | | 12/2002 | Lapoint, III |
| 7,073,676 | B1 | | 7/2006 | Town |
| 7,074,174 | B2 | | 7/2006 | Lindgren et al. |
| 7,845,511 | B1 | | 12/2010 | Strickland et al. |
| 8,191,722 | B1 | | 6/2012 | Town |

* cited by examiner

CONTAINMENT BAG SYSTEM FOR USE IN A COMMERCIAL DISPOSAL CONTAINER

PRIORITY CLAIM

This application is a continuation of application Ser. No. 10/193,558, filed on Jul. 11, 2002, now U.S. Pat. No. 8,191,722 which application was a continuation-in-part of prior pending application Ser. No. 09/930,408, filed on Aug. 15, 2001, which is now abandoned, all of which are incorporated by reference.

FIELD OF THE INVENTION

This invention relates to a containment bag system used with large dumpster style disposal containers in the storage, transportation and disposal of wastes.

PRIOR ART

In plant renovations or other type of construction or clean-up projects, wastes are generated and stored in large on-site dumpster-containers, such as rolloff containers, end dump containers, and gondola rail car containers. When hazardous materials (such as tank cleaning sludge, wet or dry waste materials, chemical plant by-products, rail wastes, high heat wastes), odorous materials, or fine particulate matter (for instance, incinerator ashes, powders, asbestos materials) are to be stored in an onsite dumpster container for later transportation and disposal, it is desirable to line the container to protect the container from exposure to the materials and to make later transportation easier. Currently, either large sheets of plastic are used to line the container or container bags are utilised. Certain wastes are unsuitable for storage in large plastic sheets or bags, such as waste rebar and concrete, where puncture of the plastic liner is a high probability. The existing container bags have openings that are closable using a series of ties or cords. Given the large size of the containers, closing the series of ties can be a time consuming chore. Further, the ties fail to make an effective seal.

SUMMARY OF THE INVENTION

This invention consists of a non-self supporting containment bag system used in conjunction with a dumpster container. The bag has two zippers or other sealable means, and a series of pick-up or attachment loops or handles that may also be attached to the outer bag material. The bag has two and possibly three layers of construction for added durability.

OBJECTS OF THE INVENTION

It is an object of the invention to provide a simple easily installable container bag for a dumpster container that is sealable.

It is another object to provide a container bag for use in a dumpster container, where the container bag has an attachment or pick-up handles and where the container bag has two layers of fabric.

It is another object of the invention to provide a containment bag for use in a dumpster container, where the container bag has a third intermediary liquid impermeable layer.

DETAILED DESCRIPTION OF THE INVENTION

Figure 1:
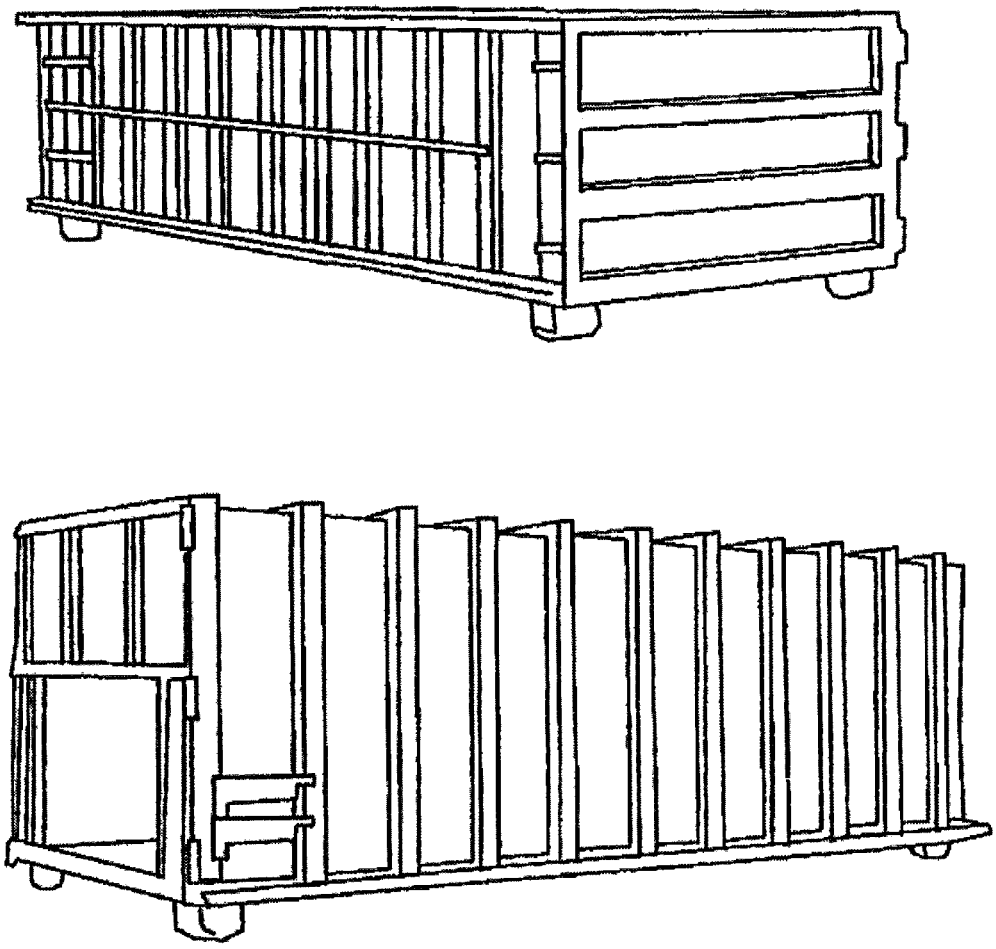
FIG. 1 is a perspective view of a rolloff container.
Figure 2:
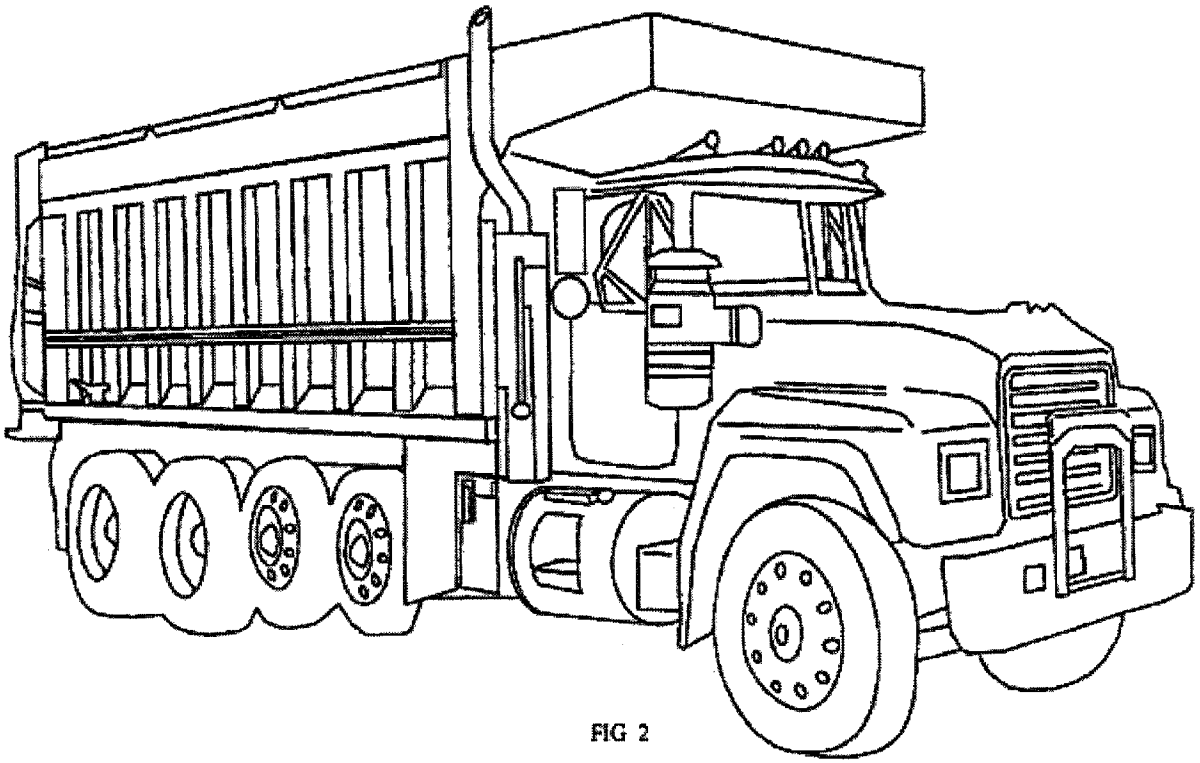
FIG. 2 is a perspective view of an end dump container.
Figure 3:
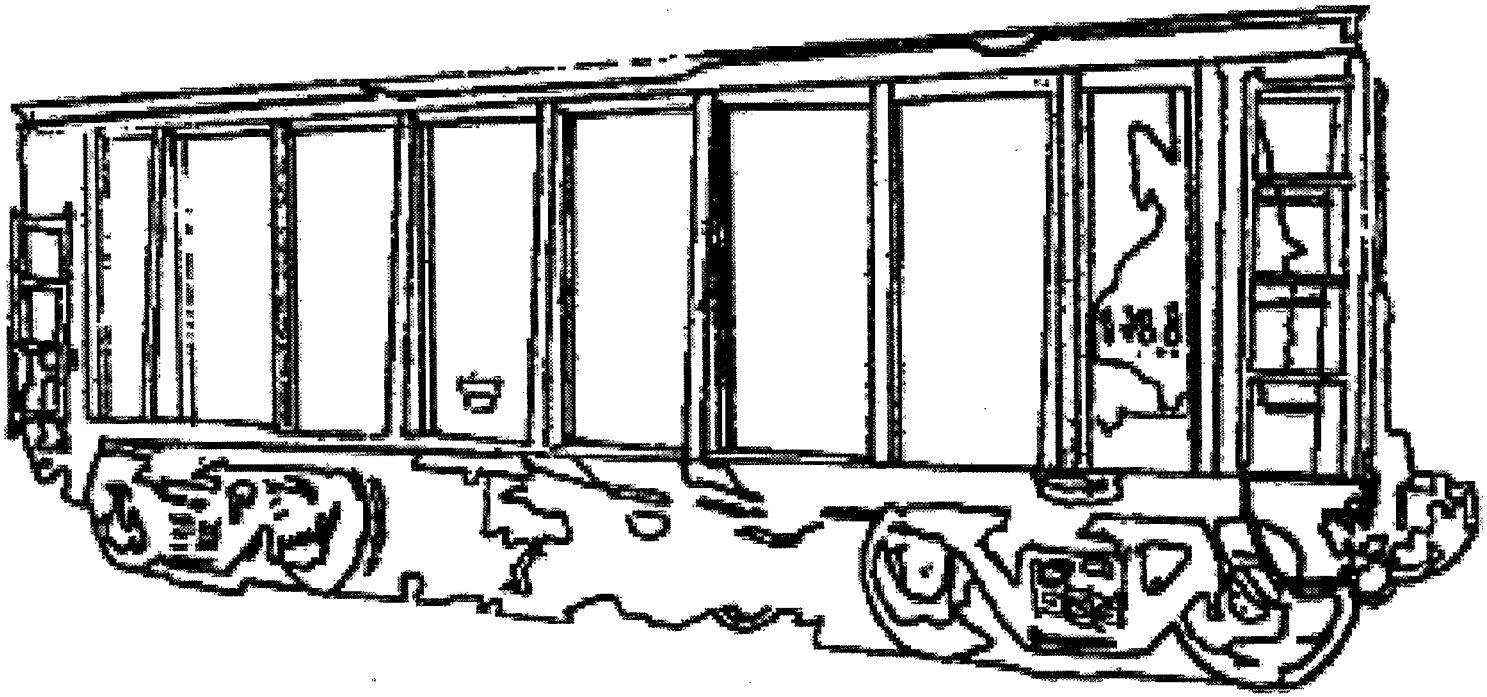
FIG. 3 is a perspective view of a gondola rail car container.
Figure 4:
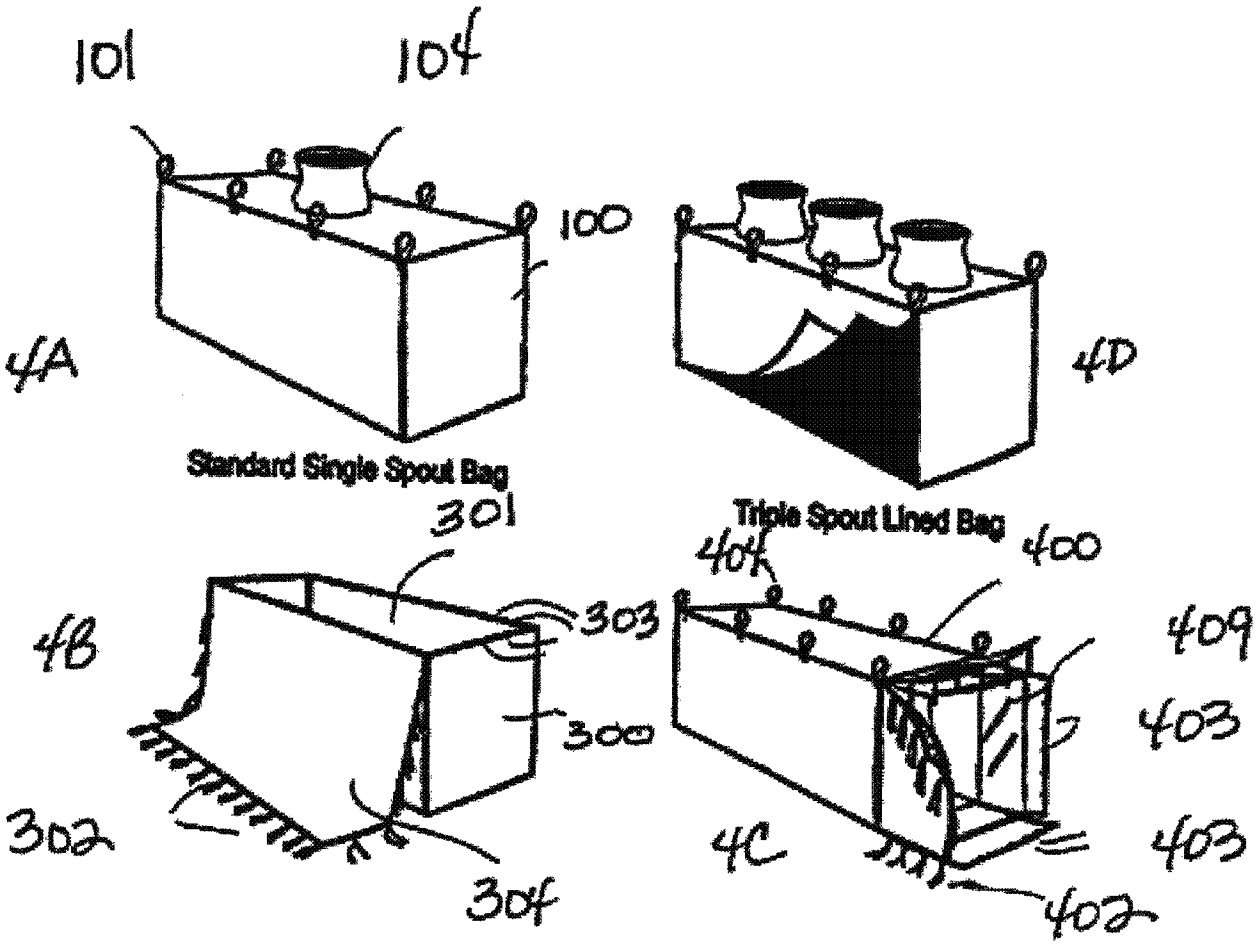
FIG. 4 shows a series of prior art container bags.

Three existing dumpster type containers are shown in FIGS. 1-3: a roll off container (FIG. 1), an end-dump container (FIG. 2) and a rail car gondola (FIG. 3). These containers range in size from 52'×10'×5' for a rail gondola to 22'×7.5'×5' for a 30 yard rolloff container. Shown in FIG. 4 are typical prior art container bags. FIG. 4*a* shows a single spout container bag 100 having a series of grab loops 101. The grab loops 101 are used to attach and support the container bag to a dumpster container. The single spout 104 provides access to the interior of the bag for loading materials into the container bag. After loading, the single spout would be tied shut with a suitable tie, such as a rope. The spout type bag can come with multiple spout configurations as shown in FIG. 4*d*.

FIG. 4*b* shows a prior art cigar top bag 300. The cigar top bag 300 has a top opening 301, which is closable by a cover 304 having a series of ties 302 located around the periphery of the top opening 301. Ties 302 attach to loops 303. FIG. 4*c* shows a prior art bread bag style container bag 400. The bread bag style is similar to the cigar top bag except the opening in the cigar top bag is located on the end instead of the top. Again, the opening is closable by tying a series of ties 402 to a matching series of loops 403. Also shown is a series of handles, shown here as loops 404, for attaching and supporting the container bag to a disposal container. Prior art bags are generally constructed of polypropylene and may have an interior lining 409, such as a polyethylene barrier attached to the interior of the bag shell.

Figure 5:
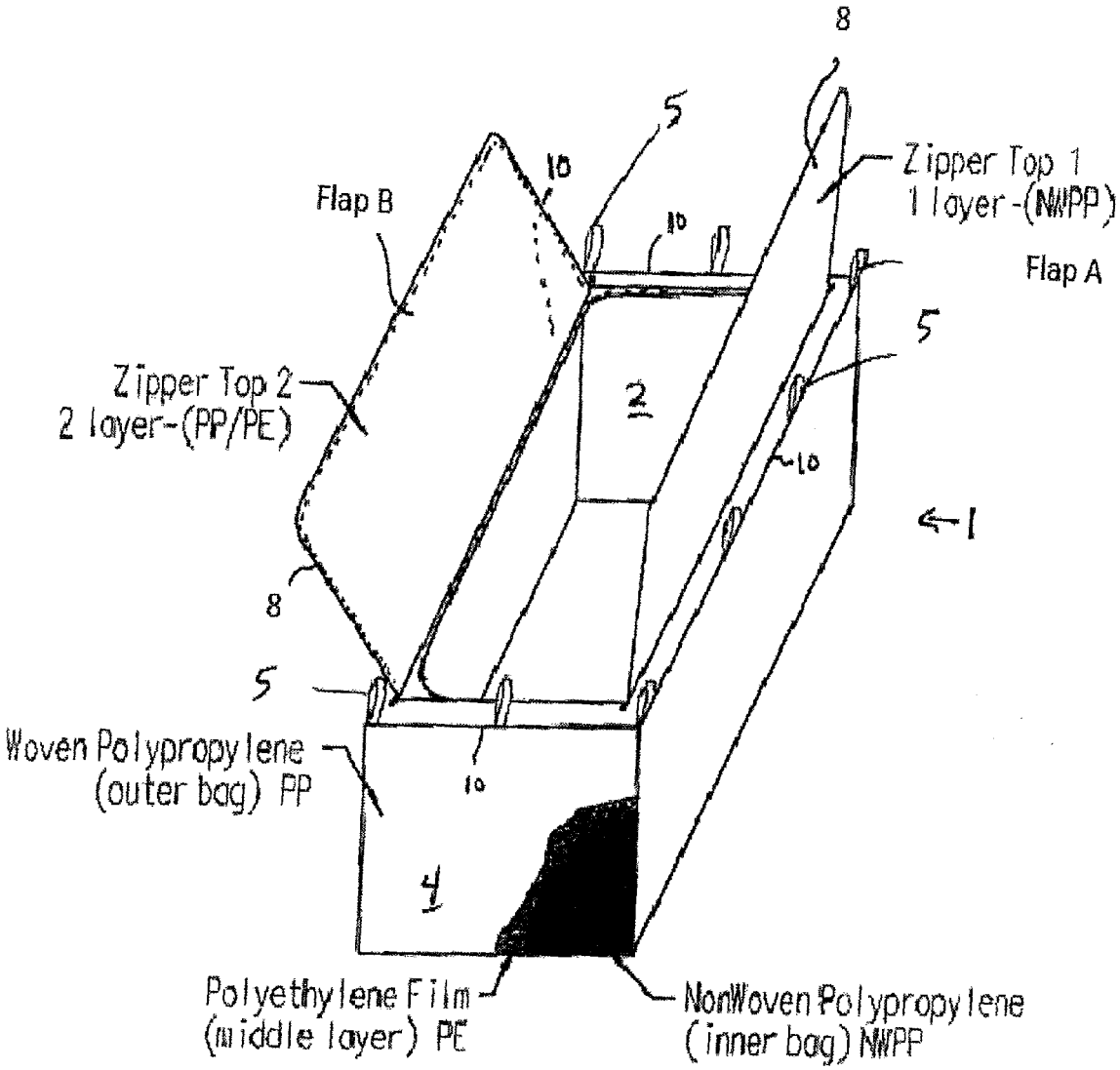
FIG. 5 is a perspective view of the containment bag invention.

Shown in FIG. 5 is containment bag 1. Containment bag 1 is made of a non-self supporting material and is designed to be inserted in a commercial dumpster container. The containment bag 1 is constructed of two layers of material: an inner nonwoven layer and an outer woven material layer. Sandwiched between the two layers may be a liquid impervious material. A preferred material for the innermost layer is nonwoven polypropylene of various weights. One embodiment uses a 16 oz. weight material. A preferred material for the outermost layer is a woven polypropylene: a typical weight is 6.5 oz. The outer woven polypropylene layer may have a coating on one side (generally the exterior side) of polyethylene, such as 1-2 mills thickness. Shown sandwiched between the innermost and outermost layer is a third layer, one impervious to water and other liquids: a preferred material is a polyethylene material, such as 6-10 mil thickness. Other materials such as polyvinyl chloride (PVC, reinforced or non-reinforced), woven or non-woven polyethylene or other suitable materials, such as woven fiberglass, may be used. In practice, two or three bags are manufactured, and one bag inserted into the next (considered a "nested relationship") until the two or three layer final product is achieved. The two or three bags are then fixedly joined by stitching together all along the top edge 10. The innermost nonwoven bag is a felt-like material that is puncture resistant. This non-woven material further operates as a thin cushion, helping to maintain bag integrity when materials are dumped into the bag. The outer woven layer is tear resistant, which helps keep the bag system together when transporting or moving a filled containment bag. The combination two-layer containment system provides a resilient and strong containment system.

The bag has an opening 2 that is sealingly closable. As shown, the system has a top opening with two sealable flaps, flap A and flap B. The innermost flap A is a continuation of the innermost non-woven material. The outermost flap B is a continuation of the woven outer material. In a three layer system, the third layer may be missing from the top or be present as either the outer surface of the innermost layer, or the inner surface of the outermost layer. As shown, each flap has a sealable closing means 8, such as a zipper. Also as shown, the two flaps are opposingly closable. This relationship is preferred, but not required. The ability to close in opposition insures that the long length-wise side of a zipper is not adjacent to another zipper, making it more difficult to penetrate the bag system.

Bag opening 2 should be placed on the bag for ease of loading and storage of materials and, in some instances, for ease of removal of the stored materials. As shown in FIG. 5, the opening is located on the "top" of the containment bag system. Alternatively, the opening could be placed on the side of the bag 4. As shown, the openings are closable with a sealable closing means, such as a zipper. A preferred zipper is a #10 coil nylon zipper, with two pulls positioned on the zipper tracks. Other zipper or zipper types can be used.

Also shown are support handles 5. The support handles 5 can serve two purposes: (1) to attach the bag to the container, and thereby support the bag for filling; and, in some instances, and (2) to assist in moving or removal of the bag from the container. Handles 5 can be loops, such as double D-ring straps or 2-inch loops, or lines or ties, and can be made from suitable materials, such as polypropylene or polyester webbing. Obviously, the support members would be attached to the exterior of the container bag. When used to attach the bag to the container, the handles will attach to points on the container, generally, at least one handle on each corner (see FIGS. 1 and 2 showing containers having a fabric top attached to the container with handles).

The container bag as shown is intended to be disposed with the stored wastes, and not intended for re-use.

Figure 6:
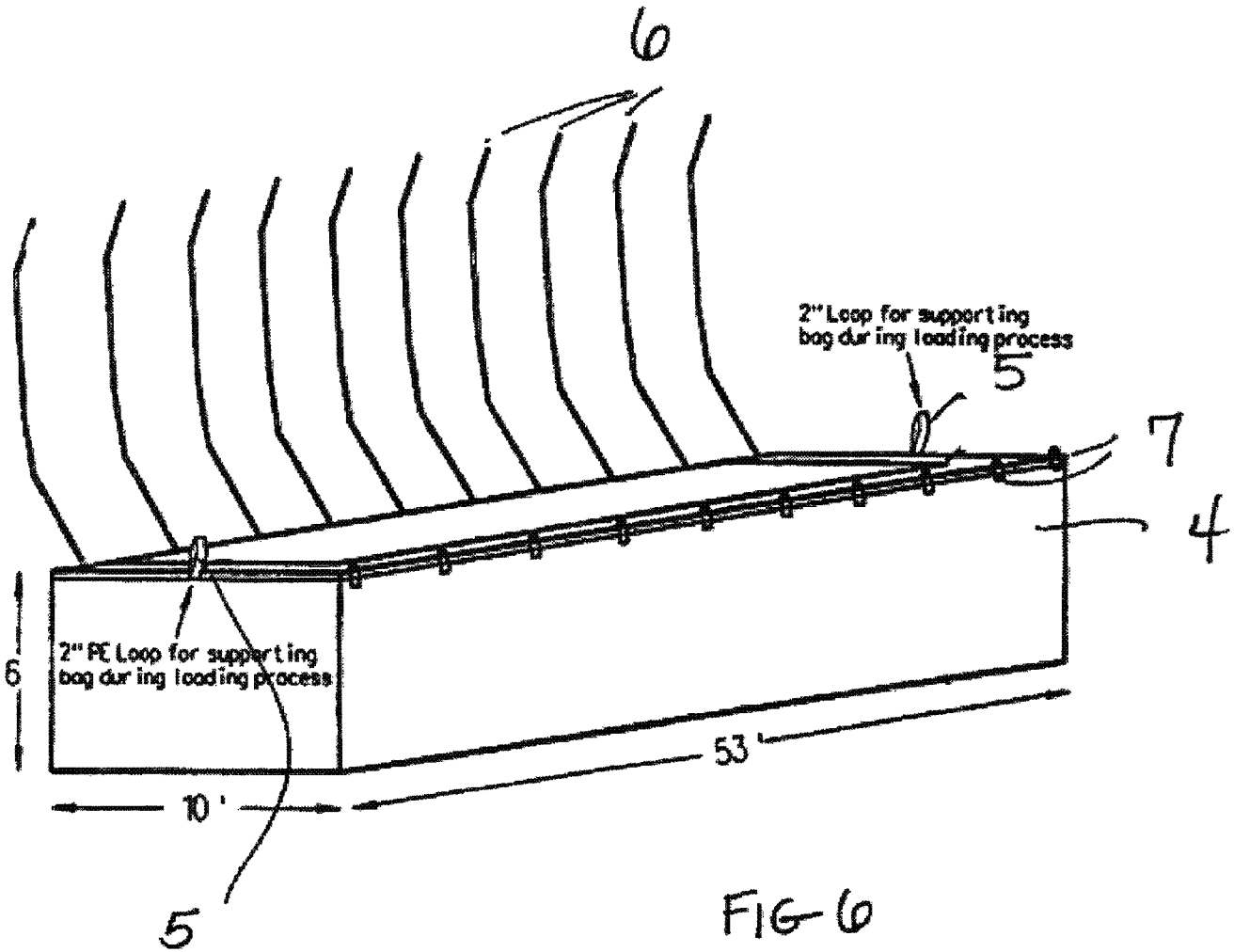
FIG. 6 is a perspective view of another embodiment of the containment bag invention.

Shown in FIG. 6 is another embodiment of the container bag 4. Bag 4 is shown having a single top opening, sealable with a zipper. Also shown are loops 5 on one side of the top and a series of straps 6 on the opposite top side. As shown, the matching loops are D-ring loops 7. The straps are of length sufficient to cross the top surface of the bag and tie into loops on the opposite top side. When so secured, these straps help resist "flapping" of the bag top during transport in an open container, such as a railcar gondola.

Figure 7:
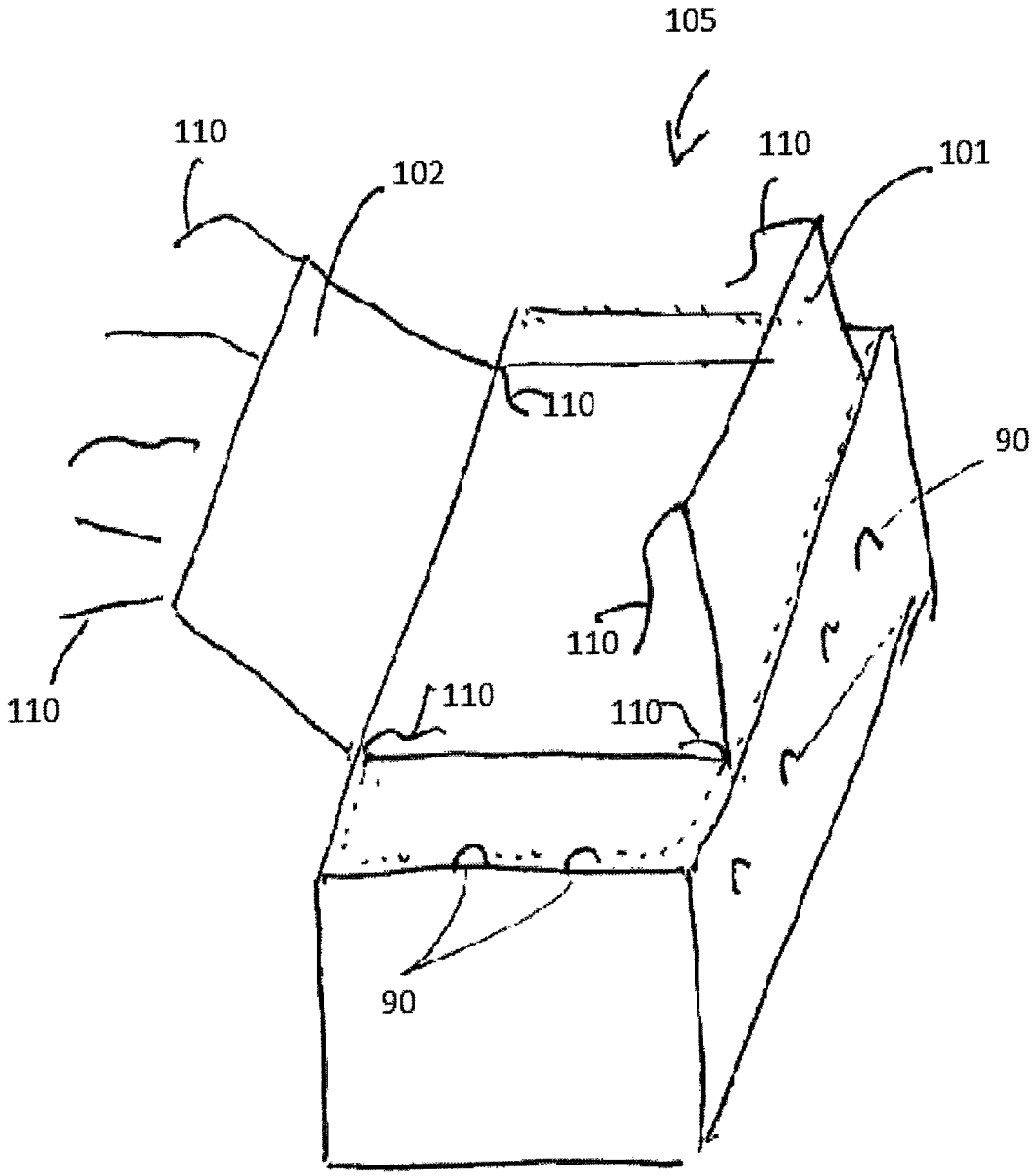
FIG. 7 is a perspective view of another embodiment of the containment bag invention.

Finally, shown in FIG. 7 is another embodiment of the invention. Shown is a bag 100 of two-layer construction: an inner layer of non-woven polypropylene and an outer bag of coated polypropylene. Each layer has an opening 105 and a top, top 101 and top 102 for closing the respective opening. As shown, the two tops close in an opposable fashion. In this embodiment, zippers are not used; instead loops, such as double D-ring straps, loops, or lines or ties, ropes or webbing 110 are positioned on the periphery of the top and are tied to a corresponding structure on the periphery of the opening. As shown, the closing structures are webbing located only on the long side of the opening and top. This embodiment is suitable for use in disposing large bulky materials, such as low level radioactive metals from demolished structures. Large bulky pieces may be very heavy and difficult to move once dropped in the bag. The bulky materials may make if difficult to close and align zippers, and consequently, other means are needed to close the openings: hence the webbing or ropes, which allows closure even if the tops cannot be fully aligned with the opening in the bag. As shown, the inner bag top 101 has two loops or webbings positioned at the corners of the open top, while the outer top 102 has a series of loops or webbings placed along the long open edge of the top. These loops or webbings tie into corresponding loops or webbings located on the corresponding edge of the bag opening. Also shown in FIG. 7 is a series of pickup loops 90.

It is intended that the following claims be interpreted as covering all such alterations and modifications and fall within the true spirit and scope of the invention.

I claim:

1. The combination of containment bag and a dumpster container, said dumpster container having a closed bottom wall and a connecting sidewall, said connecting sidewall forming an open top opposite said closed bottom wall, said connecting sidewall and said closed bottom wall forming a container interior;

said containment bag having a floor portion and a wall portion, said floor and said wall portions forming an interior; said containment bag further having an open top portion that is substantially alignable with said dumpster container open top; said floor portion and said wall portion of said containment bag comprising at least two layers, a first layer constructed of non-woven material, and a second layer constructed of woven material;

said containment bag further having a first top cover section configured to open and close, said first top cover section configured to substantially cover said open top portion when said first top cover section is closed, said first top cover section being secureable in a closed position in a covering relationship with said open top portion;

said containment bag further having a second top cover section configured to open and close, said second top cover section configured to substantially cover said open top portion when closed, said second top cover section secureable in a closed position in a covering relationship with said open top portion, wherein one of the first or second top cover sections is securable in a closed position by a zipper.

2. A containment bag and dumpster container according to claim 1 further having a series of handles positioned on the exterior of the bag.

3. A containment bag and dumpster container according to claim 1 further having a series of straps positioned on the exterior of said bag.

4. A containment bag and dumpster container according to claim 1 further having a third layer positioned between said first and said second layers.

5. A containment bag and dumpster container according to claim 4 where said third layer is constructed of waterproof materials.

6. A containment bag and dumpster container according to claim 1 where said woven material is constructed of woven polypropylene.

7. A containment bag and dumpster container according to claim 1 where said dumpster container is selected from the set of rolloff containers, end dump containers, and gondola rail car containers.

8. A containment bag and dumpster container according to claim 4 where said third layer is constructed from polypropylene.

9. A method of protecting the interior of a dumpster container wherein said dumpster container comprises a closed bottom wall and a connecting sidewall, said connecting sidewall forming an open top opposite said closed bottom wall, said connecting sidewall and said closed bottom wall forming a container interior; said method comprising the steps of placing a containment bag partially within said dumpster container interior, said containment bag comprising said containment bag having a floor portion and a wall portion, said floor and said wall portions forming an interior; said containment bag further having an open top portion; said floor portion and said wall portion of said containment bag comprising at least two layers, a first layer constructed of non-woven material, and a second layer constructed of woven material;

said containment bag further having a first top cover section configured to open and close, said first top cover section configured to substantially cover said open top portion when said first top cover section is closed, said first top cover section being secureable in a closed position in a covering relationship with said open top portion;

said containment bag further having a second top cover section configured to open and close, said second top cover section configured to substantially cover said open top portion when closed, said second top cover section secureable in a closed position in a covering relationship with said open top portion; wherein one of the first or second top cover sections is securable in a closed position by a zipper;

said method further comprising the steps of opening said first top cover section and said second top cover section, to thereby provide access to the interior of the bag, where said access is substantially aligned with said open top of said dumpster container, loading materials into the interior of said bag, and securing said first and second top cover section closed.

* * * * *